US005931254A

United States Patent [19]

Loraas et al.

[11] Patent Number: 5,931,254

[45] Date of Patent: Aug. 3, 1999

[54] NON-CONTACT OPERATOR PRESENCE SENSOR

[75] Inventors: Orlan J. Loraas, Lisbon; Scott B. Jacobson, Kindred; Kenneth A. Brandt, Wyndmere, all of N. Dak.

[73] Assignee: Clark Equipment Company, Woodcliff Lake, N.J.

[21] Appl. No.: 08/846,281

[22] Filed: Apr. 30, 1997

[51] Int. Cl.[6] ..... B60K 28/02; B60T 7/14

[52] U.S. Cl. ..... 180/272; 340/540

[58] Field of Search ..... 280/735; 180/272, 180/273, 271; 340/540, 541

[56] References Cited

U.S. PATENT DOCUMENTS

| | | | |
|---|---|---|---|
| 3,898,472 | 8/1975 | Long | 307/10 SB |
| 3,942,601 | 3/1976 | Smith | 180/82 R |
| 3,943,376 | 3/1976 | Long | 307/116 |
| 4,052,616 | 10/1977 | Keller | 250/353 |
| 4,625,329 | 11/1986 | Ishikawa et al. | 382/1 |
| 4,683,373 | 7/1987 | Tupman | 250/221 |
| 4,733,081 | 3/1988 | Mizukami | 250/341 |
| 4,887,024 | 12/1989 | Sugiyama et al. | 324/61 R |
| 5,164,709 | 11/1992 | Lamberty et al. | 340/667 |
| 5,219,413 | 6/1993 | Lineberger | 180/272 |
| 5,330,226 | 7/1994 | Gentry et al. | 280/735 |
| 5,334,972 | 8/1994 | Sugimoto et al. | 340/556 |
| 5,397,890 | 3/1995 | Schueler et al. | 250/221 |
| 5,425,431 | 6/1995 | Brandt et al. | 180/273 |
| 5,482,314 | 1/1996 | Corrado et al. | 280/735 |
| 5,531,472 | 7/1996 | Semchena et al. | 280/735 |
| 5,542,493 | 8/1996 | Jacobson et al. | 180/272 |
| 5,565,829 | 10/1996 | Loraas et al. | 335/205 |
| 5,585,625 | 12/1996 | Spies | 250/221 |
| 5,653,462 | 8/1997 | Breed et al. | 180/272 |
| 5,673,963 | 10/1997 | Pietzsch | 296/190 |
| 5,737,083 | 4/1998 | Owechko et al. | 356/375 |

FOREIGN PATENT DOCUMENTS

WO 87/01343 3/1987 WIPO .

OTHER PUBLICATIONS

"Occupant Detection Improves Restraint Performance", by Kevin Jost, admitted prior art.

*Primary Examiner*—Paul N. Dickson

*Attorney, Agent, or Firm*—Westman, Champlin & Kelly, P.A.

[57] ABSTRACT

A power machine includes a frame and a plurality of power actuators operable coupled to the frame. A power circuit is coupled to the power actuators and provides power to the power actuators. A cab is operably coupled to the frame and defines an operator compartment. The cab includes a seat supported in the operator compartment. A non-contact operator presence sensor is coupled proximate the cab and is configured to sense presence of an occupant in a predefined volume proximate the seat. The operator presence sensor provides a sensor output signal indicative of operator presence. A controller is coupled to the operator presence sensor and is configured to control operation of at least one of the plurality of power actuators based on the sensor output signal.

19 Claims, 3 Drawing Sheets

NON-CONTACT OPERATOR PRESENCE SENSOR

INCORPORATION BY REFERENCE

U.S. Pat. No. 5,425,431, entitled "INTERLOCK CONTROL SYSTEM FOR POWER MACHINE," which issued Jun. 20, 1995 to Brandt et al. and U.S. Pat. No. 5,542,493, entitled "HALL EFFECT SENSOR ASSEMBLY", which issued Aug. 6, 1996 which is hereby fully incorporated by reference.

BACKGROUND OF THE INVENTION

The present invention relates to power machinery. More particularly, the present invention relates to an operator presence sensor for power machinery.

Power machines, such as skid steer loaders, typically have a frame which supports a cab and a movable lift arm which, in turn, supports a work tool such as a bucket. The movable lift arm is pivotally coupled to the frame of the skid steer loader by power actuators which are commonly hydraulic cylinders. In addition, the tool is coupled to the lift arm by one or more additional power actuators which are also commonly hydraulic cylinders. An operator manipulating the skid steer loader raises and lowers the lift arm, and manipulates the tool, by actuating the hydraulic cylinders coupled to the lift arm and a hydraulic cylinder coupled to the tool. When the operator causes the hydraulic cylinders coupled to the lit arm to increase in length, the lift arm moves generally vertically upward. Conversely, when the operator causes the hydraulic cylinders coupled to the lift arm to decrease in length, the lift arm moves generally vertically downward. Similarly, the operator can manipulate the tool (e.g., tilt the bucket) by controlling the hydraulic cylinder coupled to the lift arm and the working tool to increase or decrease in length, as desired.

Skid steer loaders also commonly have an engine which drives the hydraulic pump to, in turn, power hydraulic traction motors which power movement of the skid steer loader. The traction motors are commonly coupled to the wheels through a drive mechanism such as a chain drive.

It is desirable that, under ceratin circumstances, the lift arm and the tool, or the drive mechanism, or both, be rendered inoperable. For example, in some prior devices, when an operator moves out of proper operating position in the cab of the skid steer loader, the hydraulic cylinders used to raise and lower the lift arm are locked out of operation. In such prior devices, an operator presence switch is coupled to the hydraulic circuit controlling the hydraulic cylinders to render the hydraulic lift cylinders inoperable when the operator presence switch indicates that the operator is out of proper operating position. One example of such a system is set out in the Minor et al. U.S. Pat. No. 4,389,154.

In addition, in some prior devices, moveable operator restraint bars are provided. When the operator restraint bars are moved to a retracted or an inoperative position, mechanical brakes or wheel locks lock the wheels of the skid steer loader. One example of such a system is set out in the Simonz U.S. Pat. No. 4,955,452.

Other power machinery, such as miniexcavators, typically have a base portion which is supported by a pair of track assemblies. The track assemblies are powered by hydraulic motors.

The base portion typically supports a house, or operator support portion. The house is rotatable relative to the base portion. Rotation is powered by a hydraulic slew motor.

Miniexcavators also typically have a number of other features. For example, a boom is typically coupled to the house. A power actuator, such as a hydraulic cylinder, is coupled to the boom to pivot the boom relative to the house about an arc substantially located in a vertical plane. The boom is also typically pivotable substantially in a horizontal plane. This type of pivoting movement is accomplished through the use of a hydraulic cylinder (referred to as an offset cylinder) coupled to the house and to the boom.

An arm is coupled to the distal end of the boom, and is also typically pivotable relative to the boom through use of a hydraulic cylinder. A tool is commonly coupled to the end of the arm and is manipulated, also through the use of a hydraulic cylinder. Such a tool may typically be a bucket pivotally coupled to the arm.

In the above types of power machines, vehicle seat switches have been used in the past in order to determine the presence of an operator in the power machine. Such seat switches typically involve a spring, or some type of bias member which biases the seat of the power machine in an upward direction. A seat switch is generally located beneath the seat and is actuated when a load is applied to the seat and deactuated when the load is removed from the seat. The switch is typically coupled to an electrical circuit which provides a signal indicative of whether the load is applied to the seat. In addition, some conventional seat switch mechanisms are configured to operate with seats which pivot in a fore and aft direction, or seats which move in a substantially vertical direction under an operator load.

All of the above switches depend on mechanical movement of the seat. In other words, most of the prior switches require physical movement of the seat in the vertical direction in order for the switch to operate properly.

SUMMARY OF THE INVENTION

A power machine includes a frame and a plurality of power actuators operably coupled to the frame. A power circuit is coupled to the power actuators and provides power to the power actuators. A cab is operably coupled to the frame and defines an operator compartment. The cab includes a seat supported in the operator compartment. A non-contact operator presence sensor is coupled proximate the cab and is configured to sense presence of an occupant in a predefined volume proximate the seat. The operator presence sensor provides a sensor output signal indicative of operator presence. A controller is coupled to the operator presence sensor and is configured to control operation of at least one of the plurality of power actuators based on the sensor output signal.

DETAILED DESCRIPTION OF THE PREFERRED EMBODIMENTS

Figure 1:
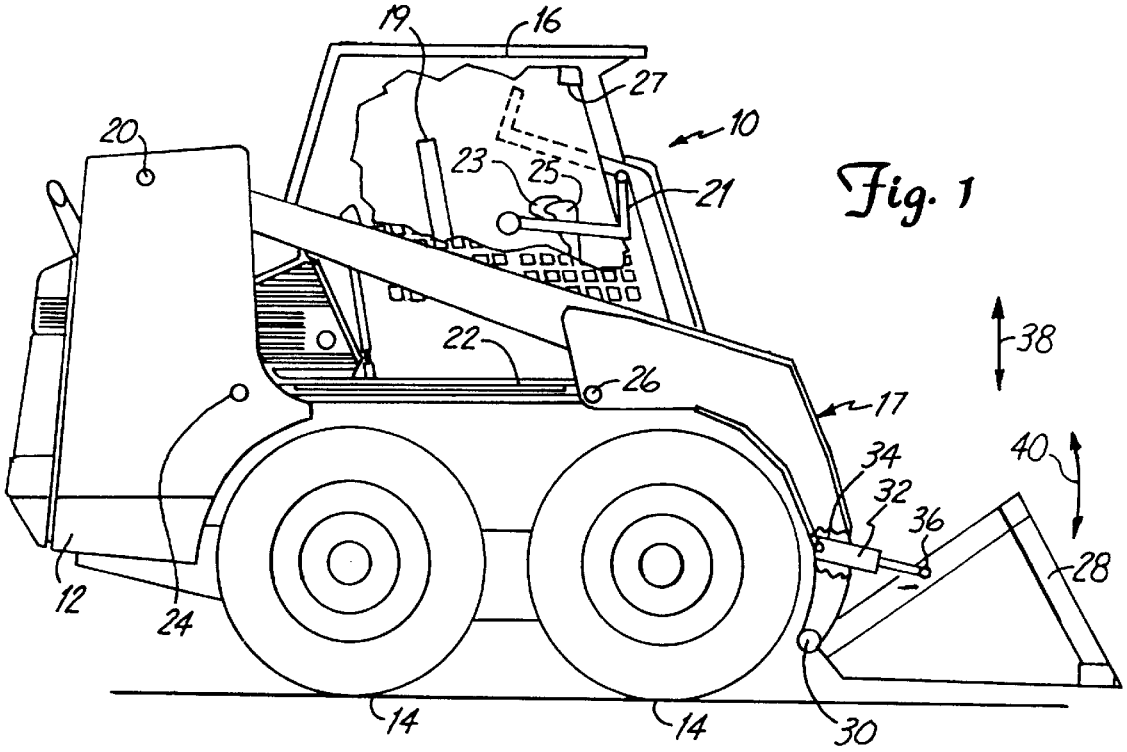
FIG. 1 is a side elevational view of a skid steer loader of the present invention.

FIG. 1 is a side elevational view of a skid steer loader 10 of the present invention. Skid steer loader 10 includes a frame 12 supported by wheels 14. Frame 12 also supports a cab 16 which defines an operator compartment and which substantially encloses a seat 19 on which an operator sits to control skid steer loader 10. A seat bar 21 is pivotally coupled within cab 16. When the operator occupies seat 19, the operator then pivots seat bar 21 from the raised position (shown in phantom in FIG. 1) to the lowered position shown in FIG. 1.

The operator compartment defined by cab 16 also includes a pair of hand grips 23 and 25 which are attached to steering levers, and which preferably support a number of operator actuable input devices (such as switches, buttons, etc.). The steering levers and the operator actuable input devices are used by the operator to control the operation of skid steer loader 10. The operator compartment may, in one preferred embodiment, also include foot pedals or other operator actuable input devices which are actuated by the operator's feet, and which are also used to control the operation of skid steer loader 10.

The operator compartment defined by cab 16 further includes non-contact operator presence sensor 27. In the preferred embodiment, sensor 27 is an infrared sensor which includes optical elements that focus the area of detection on a volume which is closely proximate seat 19. Therefore, sensor 27 detects the presence of an object in the sensed volume. Sensor 27 is described in greater detail later in the specification.

A lift arm 17 is coupled to frame 12 at pivot points 20 (only one of which is shown in FIG. 1, the other being identically disposed on the opposite side of loader 10). A pair of hydraulic cylinders 22 (one of which is shown in FIG. 1) are pivotally coupled to frame 12 at pivot points 24 and to lift 17 at pivot points 26. Lift arm 17 is also coupled to a working tool which, in the preferred embodiment, is a bucket 28. Lift arm 17 is pivotally coupled to bucket 28 at pivot points 30. In addition, another hydraulic cylinder 32 is pivotally coupled to lift arm 17 at pivot point 34 and to bucket 28 at pivot point 36. While only one cylinder 32 is shown, it is to be understood that any desired number of cylinders (or other power actuators) can be used to work bucket 28 or any other suitable tool or attachment.

The operator residing in cab 16 can manipulate lift arm 17 or bucket 28 by selectively actuating hydraulic cylinders 22 and 32. When the operator causes hydraulic cylinders 22 to increase in length, and to decrease in length, lift arm 17 (and consequently bucket 28) move generally vertically upward and downward, respectively, in the direction generally indicated by arrow 38. Also, when the operator causes cylinder 32 to increase and decrease in length, bucket 28 pivots generally along an arc indicated by arrow 40.

Figure 2:
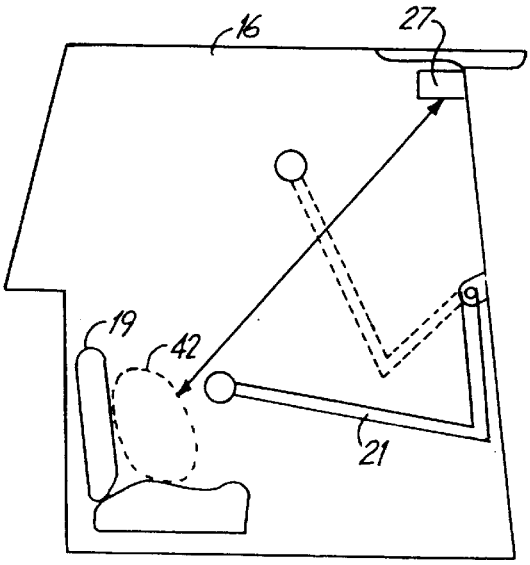
FIG. 2 is a side view of a portion of an operator compartment of the skid steer loader shown in FIG. 1.

FIG. 2 is a side view of a portion of the operator compartment defined by cab 16. FIG. 2 illustrates that operator presence sensor 27 is configured to detect the presence of an object in a sensed volume indicated by the dashed line 42 shown in FIG. 2. It should be noted that sensed volume 42 is preferably three dimensional and extends transversely across a portion of seat 19. In the preferred embodiment, sensed volume 42 is located proximate a volume which would be normally occupied by the hip region of an operator. This reduces the likelihood that the limbs, or upper torso of the operator, when moving during operation of loader 10, will move out of the sensed volume and thereby cause an erroneous vacancy detection (or operator absent detection) by the operator presence sensor 27.

FIG. 2 shows presence sensor 27 located in a forward region of the operator compartment defined by cab 16. In the preferred embodiment, sensor 27 is located in an upward, forward corner of the operator compartment. However, it should be noted that there are many different suitable locations for sensor 27, including substantially any area where operator presence sensor 27 can sense a desired volume proximate seat 19.

Figure 3:
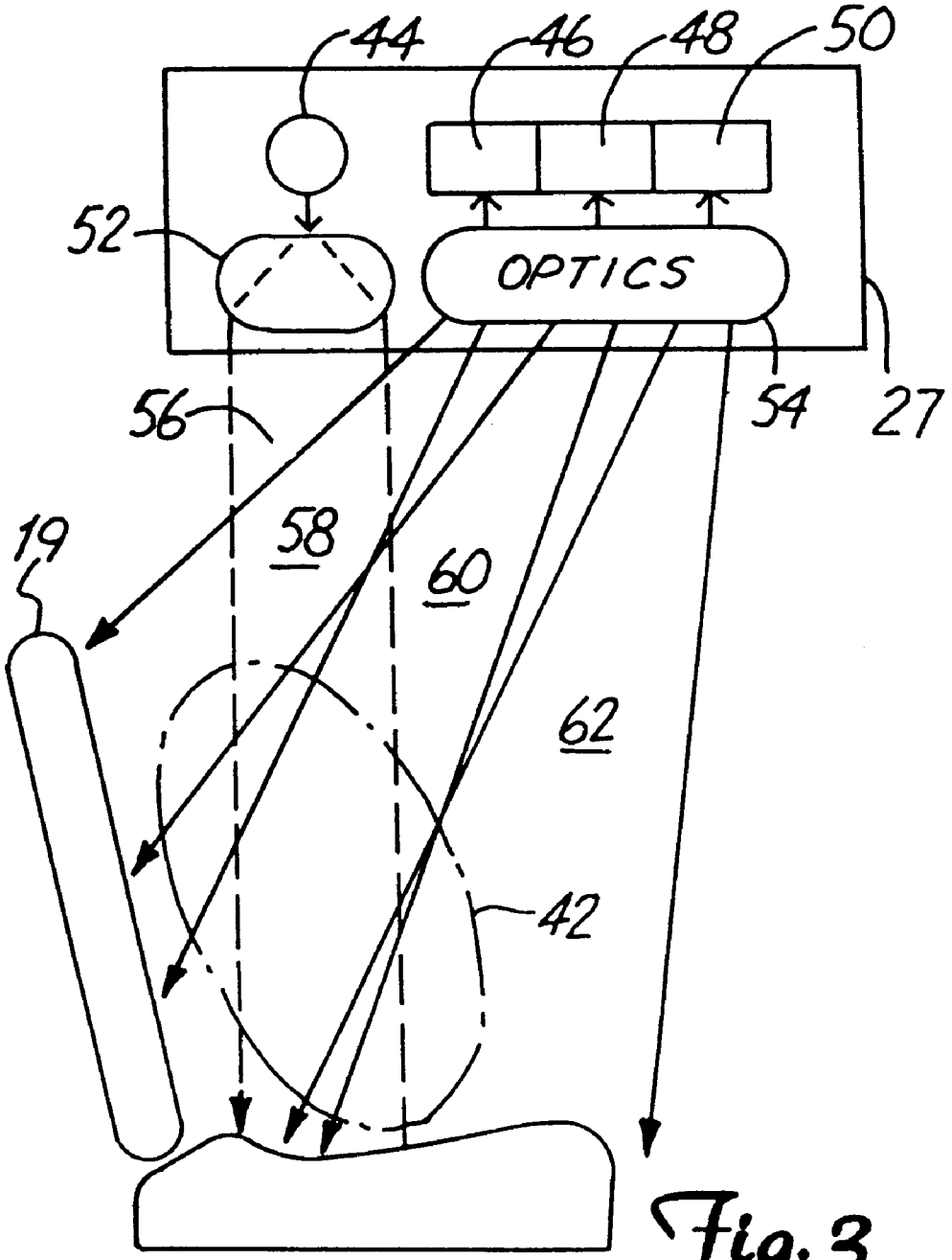
FIG. 3 illustrates operation of an operator presence sensing system in accordance with the present invention.

FIG. 3 illustrates the operation of operator presence sensor 27 in greater detail. In the embodiment shown in FIG. 3, operator presence sensor 27 includes light emitter 44, a plurality of light detectors (in the preferred embodiment shown in FIG. 3 there are three light detectors) 46, 48 and 50, an optics portion 52 associated with light emitter 44 and an optics portion 54 associated with detectors 46, 48 and 50. Light emitter 44 is preferably a light emitting diode which emits light in a desired frequency range, such as in the infrared range. Light detectors 46, 48 and 50, are preferably detectors which detect light in the range emitted by light emitter 44. It should be noted that any suitable number or type of detectors can be used (as described in greater detail later). However, in the preferred embodiment shown in FIG. 3, three detectors are used.

Optics portion 52 preferably includes a dispersive element and collimating element which substantially uniformly disperses the light emitted by emitter 44 and columniates that light and directs it in a direction such that it impinges on the desired sensed volume 42. The radiation emanating from lens 52 preferably impinges on, and illuminates a substantial part, or all, of sensed volume 42. In FIG. 3, the light emanating from lens 52 is shown as a cylinder or parallelapiped 56 which covers a substantial portion of sensed volume 42. It should be noted, however, that the light emanating from lens 52 can be any suitable shape, such as a cone, or another suitable shape.

Optical portion 54 includes one or more lenses what serve to focus light emitted by emitter 44 and reflected from a point or an object residing in sensed volume 42 back to detectors 46, 48, and 50. In the embodiment shown in FIG. 3., the lenses in optical portion 54 focus light reflected from a point or an object residing in a volume 58 back to detector 46. Further, the lenses in optical portion 54 focus light reflected from a point or an object in volume 60 back to detector 48, and they focus light reflected from an object in volume 62 back to detector 50. In the embodiment shown in FIG. 3, the volumes 58, 60 and 62 are generally cone shaped. However, it should be noted that any suitable shape can be used, and this can be obtained by simply changing the configuration of the lenses forming optical portion 54.

FIG. 3 also illustrates that, in the preferred embodiment, the volumes 58, 60 and 62, from which light is reflected and sensed by detectors 46, 48 and 50, overlap in the sensed volume 42. This feature is used in processing the sensor signals received from detectors 46, 48 and 50, as is described with respect to FIG. 4.

Figure 4:
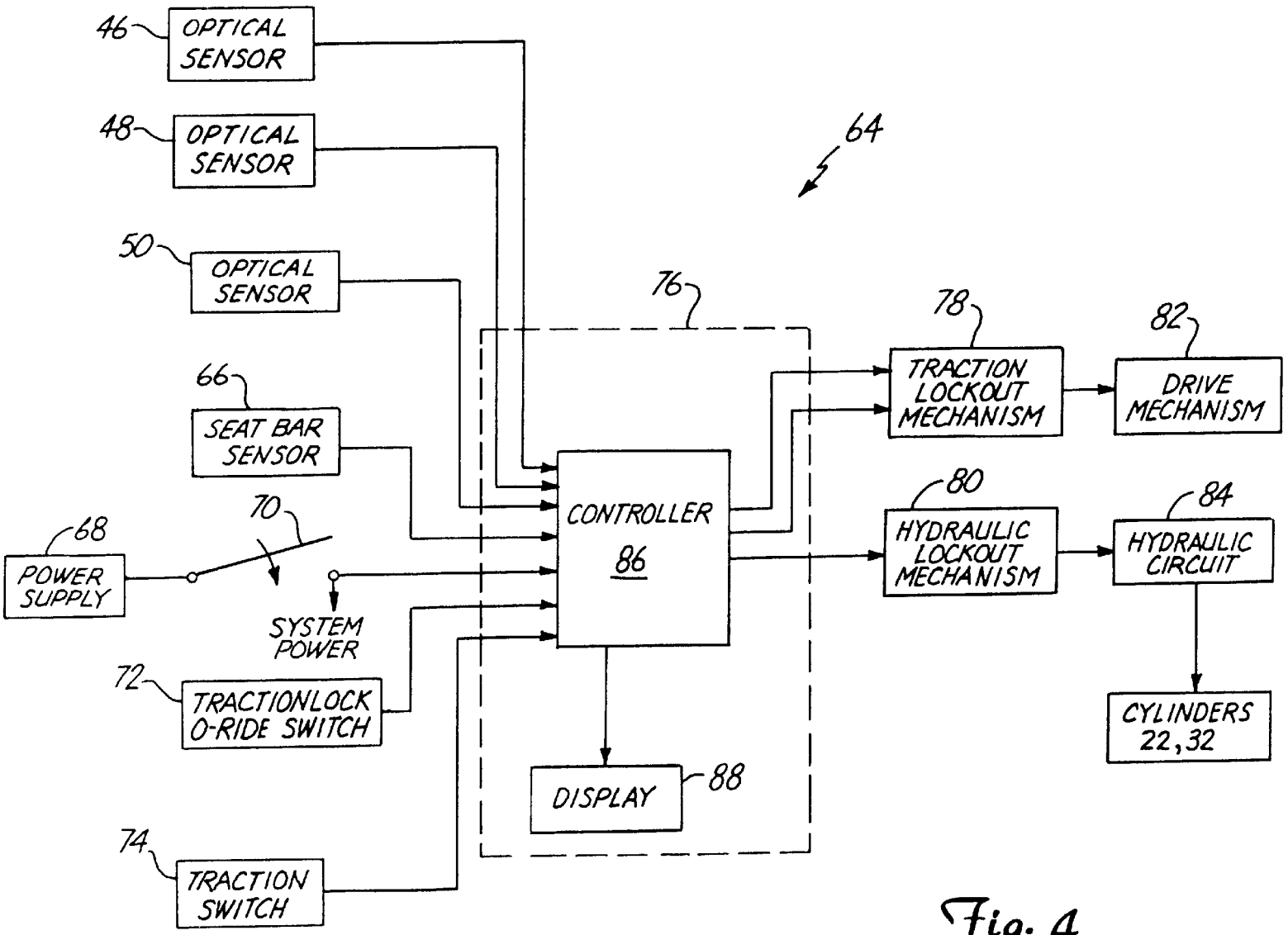
FIG. 4 is a block diagram of one embodiment of a control system in accordance with the present invention.

FIG. 4 illustrates a block diagram of control circuit 64. Control circuit 64 includes optical sensors or detectors 46, 48 and 50, seat bar sensor 66, power supply 68, ignition switch 70, traction lock override switch 72, traction switch 74, controller assembly 76, traction lockout mechanism 78, hydraulic lockout mechanism 80, drive mechanism 82, hydraulic circuit 84, and power actuators, such as cylinders 22 and 32. Controller assembly 76 includes controller 86 and display 88. In the preferred embodiment, controller 86 is a digital computer, or other suitable microcontroller, along with associated circuitry such as memory, timing circuitry, and other suitable support circuitry. Display 88 is preferably any suitable operator-observable display such as LEDs, an LCD display, a CRT display or any other suitable display.

Controller 86 receives inputs from optical sensors 46, 48 and 50, seat bar sensor 66, traction lock override switch 72 and traction switch 74. Ignition switch 70 is coupled to power supply 68. Upon closing of ignition switch 70, power is supplied from power supply 68 to the remainder of the system.

Based on the inputs received, controller 86 provides two outputs to traction lockout mechanism 78, and an output to hydraulic lockout mechanism 80. Controller 86 also provides an output to display 88 which provides operator-observable indicia indicating the state of various operating conditions of machine 10.

Based on the outputs received from controller 86, traction lockout mechanism 78 and hydraulic lockout mechanism 80 provide outputs to drive mechanism 82 and hydraulic circuit 84, respectively. Hydraulic circuit 84, in turn, provides an output (in the embodiment shown in FIG. 4) to lift and tilt cylinders 22, 32.

In operation, optical sensors 46, 48 and 50 provide signals to controller 86 indicating whether anything is residing in volumes 58, 60 and 62, respectively. Based on these signals, controller 86 determines whether an operator present condition exists, or whether an operator absent condition exists. This is described in greater detail below.

Seat bar sensor 66 is preferably a Hall effect position sensor more fully described in U.S. Pat. No. 5,542,493, which is incorporated fully herein by reference. Seat bar sensor 66 senses whether seat bar 21 is in the raised or lowered position (shown in FIG. 2). In the preferred embodiment, seat bar sensor 66 is activated when the operator pulls seat bar 21 into the lowered position shown in FIG. 2. Thus, in the preferred embodiment, seat bar sensor 66 provides a signal to controller 86 which is active when seat bar 21 is in the lowered position and inactive when seat bar 21 is in the raised position, or in any position other than the lowered position.

Ignition switch 70 is preferably a typical key-type ignition switch used in supplying power from power supply 68 to the basic electrical system in loader 10. Upon the closure of ignition switch 70, power is also supplied to controller 86 which senses that switch 70 is closed. Of course, it should be noted that switch 70 could also be another type of operator actuable input, such as a rocker switch, a membrane keypad input, or another suitable input.

Traction lock switch 74 is preferably an operator-controlled pedal actuated switch accessible from the operator compartment defined by cab 16. The pedal is preferably configured as an over-center device. When the operator actuates traction switch 74, traction switch 74 provides an input to controller 86 requesting controller 86 to activate traction lockout mechanism 78.

Traction lock override switch 72 is preferably a manually operated switch which is also located in the operator compartment defined by cab 16. Switch 72 can be of any suitable configuration, but is preferably a push button switch located on a dash panel in a forward region of the operator compartment and is used to override certain selected lockout conditions.

Traction lockout mechanism 78, in the preferred embodiment, comprises the mechanism more fully described in co-pending U.S. patent application Ser. No. 08/198,957, filed on Feb. 22, 1994. Briefly, traction lockout mechanism 78 locks or unlocks drive mechanism 82 in response to input signals to either preclude movement of skid steer loader 10 or allow movement of skid steer loader 10, respectively.

Hydraulic lockout mechanism 80 is more fully described in co-pending U.S. patent application Ser. No. 08/199,120, filed Feb. 22, 1994. Briefly, hydraulic circuit 68 includes hydraulic valves which are actuated to provide fluid under pressure to power actuators on loader 10, such as cylinders 22 and 32, to achieve desired manipulation of those actuators. Hydraulic lockout mechanism 80, in the preferred embodiment, includes any number of lock valves interposed between the valves in hydraulic circuit 84 and the power actuators. Upon receiving appropriate control signals from controller 86, the lock valves in hydraulic lockout mechanism 80 preclude hydraulic circuit 84 from providing fluid under pressure to the power actuators, thereby locking the power actuators, or allowing only selected operations of the power actuators. Of course, hydraulic lockout mechanism 80 could also include any other suitable mechanism for limiting or precluding operation of selected power actuators.

During normal operation of circuit 64, an operator enters the operator compartment defined by cab 16 and occupies seat 19. The operator then lowers seat bar 21 into the lowered position shown in FIG. 1. The operator then closes ignition switch 70 supplying power to the basic electrical system, to controller assembly 76, and to the remainder of the control system. Optical sensors 46, 48 and 50, and seat bar sensor 66, provide signals to controller 86 indicating that seat 19 is occupied and that seat bar 21 is in the lowered position.

Upon receiving such signals, controller 86 provides appropriate signals to traction lockout mechanism 78 to unlock drive mechanism 82, and allow movement of loader 10, and to hydraulic lockout mechanism 80 to unlock hydraulic circuit 84 and allow manipulation of the power actuators on loader 10. Also, controller 86 provides display signals to display 88 which indicate that seat 19 is occupied, seat bar 21 is in the lowered position, and hydraulic lockout mechanism 80 has been sent a signal by controller 86 to unlock hydraulic circuit 84 and drive mechanism 82 and that controller 86 does not detect any system problems.

If controller 86 has not received a signal from optical sensors 46, 48 and 50 indicating that seat 19 is occupied, and has not received a signal from seat bar sensor 66 indicating that seat bar 21 is in the lowered position, controller 86 provides appropriate signals to traction lockout mechanism 78 and hydraulic lockout mechanism 80 locking drive mechanism 82 and hydraulic circuit 84, respectively.

Controller 86 can be programmed to determine that the operator is present in seat 19 when any one, or any combination of, sensors 46, 48 and 50 provide a signal indicating the presence of an object in the corresponding volumes 58, 60 and 62. However, in the preferred embodiment, controller 86 does not interpret the signals from optical sensors 46, 48 and 50 as though they are indicating an operator present condition unless all three sensors provide a signal which indicates that something is present in the associated volumes 58, 60 and 62, respectively. In other words, all three sensors preferably must sense the presence of an object in order for controller 86 to determine that an operator is present in seat 19.

By implementing optical portion 54 accordingly, volumes 58, 60 and 62 can be positioned such that they overlap in the sensed volume 42. In this way, controller 86 can be substantially assured that the item being detected by optical sensors 46, 48 and 50 is actually within the sensed volume 42, and is not outside that volume. For instance, seat bar 21, when raised and lowered, can pass through, or reside in, any of volumes 58, 60 and 62. However, in one preferred embodiment, at no point during its travel will it reside in all three volumes at once. Therefore, controller 86 will not mistakenly determine that an operator is present based on the signals received from optical sensors 46, 48 and 50 due to seat bar 21. Rather, controller 86 will only determine that an operator is present when something resides in sensed volume 42, which preferably coincides to the hip region of an operator properly seated within seat 19.

While sensors 46, 48 and 50 have been described as sensors which simply provide an on/off type signal indicative of the presence or absence of an object in the sensed volume, they could be other types of sensors as well. For instance, the sensors can provide an analog output which has a magnitude indicative of the presence of an object or some other characteristic of the object as well, such as size.

It should also be noted that controller 86 may preferably perform other analysis on the signals received from sensors 46, 48 and 50 as well. For example, in one preferred embodiment, controller 86 compares signals received from closely proximate time intervals. In this way, controller 86 determines whether movement has occurred in the region of seat 19. For instance, if optical sensors 46, 48 and 50 are progressively activated and deactivated, that would tend to indicate to controller 86 that an object has moved through volumes 58, 60 and 62, one at a time. This could arise, for instance, by the operator waving a limb or a tool proximate, detector 27. Further, this could possibly result from the movement of seat bar 21.

Also, optical sensors 46, 48 and 50 can be replaced by a charge coupled image sensing device, or other suitable cameras with overlapping fields of view, the overlapping fields of view corresponding to volumes 58, 60 and 62. In that case, the signals received by controller 86 are analyzed in one of a number of ways. For instance, such signals are preferably analyzed by controller 86 to perform a shape analysis. In essence, a shape analysis determines whether an object which is larger or smaller than expected (or which has a silhouette which is different than expected) is within the sensed volume 42. In performing such an analysis, controller 86 essentially counts a number of picture elements (pixels) in any given image sensed by the charge coupled devices. Controller 86 then compares the size of that image to the size of an expected image to determine whether an appropriate image has been intruded into volume 42.

In the embodiment where optical sensors 46, 48 and 50 are charge coupled image sensors, controller 86, in another preferred embodiment, performs a color content analysis. The color of an object sensed by the charge coupled devices is determined by analyzing relative intensities of the red, green and blue colors recorded. This is preferably done by a hue, intensity, saturation (HIS) analysis technique which is a known technique.

In addition, in the embodiment in which optical sensors 46, 48 and 50 are charge coupled image sensors, controller 86 may, in another preferred embodiment, perform object motion analysis. This is done in a similar fashion to the embodiment where optical sensors 46, 48 and 50 are simply radiation detectors. In other words, controller 86 compares the image signals received from the optical sensors during two different time periods to determine whether an sensed object has moved within the fields of view of the charge coupled image sensors.

In another preferred embodiment, detector 27 does not only include three optical sensors, but is implemented using an integrated circuit device which has many more optical sensors, such as an array of 256 optical sensors. In this embodiment, even though the optical sensors are not charge coupled image sensors, they still provide a great deal more information than simply three overlapping radiation detectors. By having 256 different fields of detection associated with 256 different detectors, controller 86 preferably does a fairly detailed analysis of the silhouette of the item sensed by the detectors. This is then used to discriminate between different items which may intrude into the fields of detection of the sensors. For example, this information can be used to distinguish between an operator in seat 19, and a tool which has been set on seat 19, or seat bar 21, or any other item, other than an operator, which has a different silhouette than an operator.

Further, it should be noted that sensors 46, 48 and 50 can be provided with a separate controller (not shown) which performs the necessary analysis on the signals received from the sensors. The controller then preferably communicates with controller 86 using a serial communication stream.

Thus, the present invention provides a non-contact operator presence sensor on power machines, such as skid steer loaders and miniexcavators. The particular implementation of the sensor can take one of a number of different embodiments and the output signals from the sensor can be analyzed in many different ways to obtain desired information.

Although the present invention has been described with reference to preferred embodiments, workers skilled in the art will recognize that changes may be made in form and detail without departing from the spirit and scope of the invention.

What is claimed is:

1. A skid steer loader, comprising:

a frame;

a plurality of power actuators operably coupled to the frame;

a power circuit coupled to the power actuators and providing power to the power actuators;

a cab operably coupled to the frame and defining an operator compartment, the cab including a seat supported in the operator compartment;

a non-contact operator presence sensor coupled proximate the cab and configured to sense presence of an occupant in a predefined volume proximate the seat and to provide a first sensor output signal indicative of operator presence, the operator presence sensor including a radiation source and a plurality of detectors, each detector arranged to detect radiation from one of a plurality of detected volumes proximate the seat and to provide a detector output signal indicative of whether an object is in a corresponding detected volume based on the radiation detected, the plurality of detectors configured such that at least two of the plurality of detected volumes overlap proximate the predefined volume; and a controller coupled to the operator presence sensor and configured to control operation of at least one of the plurality of power actuators based on the first sensor output signal.

2. The skid steer loader of claim 1 wherein the controller is configured to modify functionality of at least one of the power actuators based on the first sensor output signal.

3. The skid steer loader of claim 2 wherein the first sensor output signal indicates one of an operator present condition and an operator absent condition, and wherein the controller is configured to preclude selected functions of the at least one power actuator in response to an operator absent condition.

4. The skid steer loader of claim 1 and further comprising:

a second sensor coupled to the controller and sensing a second operational condition of the skid steer loader and providing a second sensor output signal indicative of the second operating condition to the controller, the controller being configured to control operation of the power actuators based on the first sensor output signal and the second sensor output signal.

5. The skid steer loader of claim 4 wherein the power actuators include a traction mechanism operably coupled to the frame for driving movement of the skid steer loader, and wherein the controller is configured to lock the traction mechanism to inhibit movement of the skid steer loader in response to the operator presence sensor indicating an operator absent condition.

6. The skid steer loader of claim 4 wherein the power actuators include hydraulic cylinders operably coupled to the frame for driving movement of a portion of the skid steer loader, and wherein the controller is configured to limit movement of the hydraulic cylinders in response to the operator presence sensor indicating an operator absent condition.

7. The skid steer loader of claim 1 wherein the first sensor output signal comprises a plurality of detector output signals, one from each of the plurality of detectors, and wherein the controller is configured to control the power actuators based on an operator absent condition unless at least two of the plurality of detectors provide corresponding detector output signals indicating that an object is within the corresponding detected volumes.

8. The skid steer loader of claim 7 wherein the controller is configured to discriminate between different objects in the predetermined volume based on the detector output signals.

9. The skid steer loader of claim 7 wherein the controller is configured to detect movement of an object through the predetermined volume based on the detector output signals.

10. The skid steer loader of claim 7 wherein the controller is configured to discriminate between different shapes residing in the predetermined volume based on the detector output signals.

11. A power machine, comprising:

a frame;

a plurality of power actuators operably coupled to the frame;

a power circuit coupled to the power actuators and providing power to the power actuators;

a cab operably coupled to the frame and defining an operator compartment, the cab including a seat supported in the operator compartment;

a non-contact operator presence sensor coupled proximate the cab and configured to sense presence of an occupant in a predefined volume proximate the seat and to provide a first sensor output signal indicative of operator presence, the operator presence sensor including a radiation source and a plurality of detectors, each detector arranged to detect radiation from one of a plurality of detected volumes proximate the seat and to provide a detector output signal indicative of whether an object is in a corresponding detected volume based on the radiation detected, the plurality of detectors configured such that at least two of the plurality of detected volumes overlap proximate the predefined volume; and a controller coupled to the operator presence sensor and configured to control operation of at least one of the plurality of power actuators based on the first sensor output signal.

12. The power machine of claim 11 wherein the first sensor output signal indicates one of an operator present condition and an operator absent condition, and wherein the controller is configured to preclude selected functions of the at least one power actuator in response to an operator absent condition.

13. The power machine of claim 11 and further comprising:

a second sensor coupled to the controller and sensing a second operational condition of the power machine and providing a second sensor output signal indicative of the second operating condition to the controller, the controller being configured to control operation of the power actuators based on the first sensor output signal and the second sensor output signal.

14. The power machine of claim 13 wherein the power actuators include a traction mechanism operably coupled to the frame for driving movement of the power machine, and wherein the controller is configured to lock the traction mechanism to inhibit movement of the power machine in response to the operator presence sensor indicating an operator absent condition.

15. The power machine of claim 14 wherein the power actuators include hydraulic cylinders operably coupled to the frame for driving movement of a portion of the power machine, and wherein the controller is configured to limit movement of the hydraulic cylinders in response to the operator presence sensor indicating an operator absent condition.

16. The power machine of claim 11 wherein the first sensor output signal comprises a plurality of detector output signals, one from each of the plurality of detectors, and wherein the controller is configured to control the power actuators based on an operator absent condition unless at least two of the plurality of detectors provide corresponding detector output signals indicating that an object is within the corresponding detected volumes.

17. The power machine of claim 16 wherein the controller is configured to discriminate between different objects in the predetermined volume based on the detector output signals.

18. The power machine of claim 17 wherein the controller is configured to detect movement of an object through the predetermined volume based on the detector output signals.

19. The power machine of claim 18 wherein the controller is configured to discriminate between different shapes residing in the predetermined volume based on the detector output signals.

* * * * *